US006617777B2

(12) United States Patent
Taguchi et al.

(10) Patent No.: US 6,617,777 B2
(45) Date of Patent: Sep. 9, 2003

(54) ELECTRON GUN FOR CATHODE RAY TUBE

(75) Inventors: Yuji Taguchi, Osaka (JP); Masahiko Konda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/897,554

(22) Filed: Jul. 2, 2001

(65) Prior Publication Data

US 2002/0003394 A1 Jan. 10, 2002

(30) Foreign Application Priority Data

Jul. 7, 2000 (JP) ..... 2000-206489

(51) Int. Cl.[7] ..... H01J 29/51
(52) U.S. Cl. ..... 313/412
(58) Field of Search ..... 313/414, 450, 313/451, 452, 456, 445, 454, 412

(56) References Cited

U.S. PATENT DOCUMENTS 2,790,105 A * 4/1957 Hines ..... 315/3.5
4,899,079 A 2/1990 Van Gorkum et al.
6,133,685 A 10/2000 Konda et al.

FOREIGN PATENT DOCUMENTS

| | | |
|---|---|---|
| JP | 61-29047 | 2/1986 |
| JP | 10-74465 | 3/1998 |
| JP | 2000-188067 | 7/2000 |

* cited by examiner

*Primary Examiner*—Sandra O'Shea
*Assistant Examiner*—Sumati Krishnan
(74) *Attorney, Agent, or Firm*—Merchant & Gould P.C.

(57) ABSTRACT

A electron gun has a plurality of arranged tubular electrodes for passing electron beams inside the tubular electrodes, and the tubular electrodes are fixed to support rods respectively by support members. At least one of the tubular electrodes is separated into two parts, and the separated two tubular electrode parts are connected electrically with each other by a coil member provided therebetween. The coil member is composed of a wire with its tip ends being located within the spaces formed by the support members. A desired electron beam modulation effect can be provided without interrupting transmission of a modulation magnetic field from the exterior, and also electric field emission of electrons from the tip ends of the coil member is suppressed.

8 Claims, 4 Drawing Sheets

ELECTRON GUN FOR CATHODE RAY TUBE

FIELD OF THE INVENTION

The present invention relates to an electron gun for a cathode ray tube. More specifically, the present invention relates to a technique to improve a high frequency magnetic field transmission property of an electron gun.

BACKGROUND OF THE INVENTION

FIG. 6 shows a structure of a conventional electron gun for a projection-type monochrome cathode ray tube disclosed in JP-A-10-74465. FIG. 6 is an enlarged cross-sectional view of a neck tube portion.

As shown in FIG. 6, the state-of-the-art for improving focusing performance is subjecting the electron gun disposed inside a neck tube 3 to magnetic field modulation caused by a velocity modulation coil 20 from outside of the neck tube 3 in order to carry out velocity modulation of an electron beam. Namely, an electron beam (not shown) emitted from a cathode 7 housed in a G1 electrode (control electrode) 6 is modulated by an alternating magnetic field generated by the velocity modulation coil 20, a convergence yoke 23, a deflection yoke 24 and the like, during a passage of the electron beam from a G2 electrode (acceleration electrode) 8 to a phosphor screen surface (not shown).

The deflection yoke 24, which is attached to a funnel cone portion of the cathode ray tube, generates an alternating magnetic field to deflect an electron beam, so that the electron beam scans the phosphor screen surface of the cathode ray tube. The convergence yoke 23, attached to the outside of the neck tube 3 of the cathode ray tube, corrects raster distortion and color displacement by generating an alternating magnetic field 22 to modulate the electron beam. The velocity modulation coil 20 is attached to the outside of the neck tube 3 of the cathode ray tube and generates alternating magnetic field 21 to modulate the scanning speed of the electron beam in order to prevent a high-intensity part on the phosphor screen from extending to a low-intensity part and to sharpen images.

The frequency of an alternating magnetic field for modulating an electron beam ranges from a deflection frequency (15.75 kHz) to a mega-Hertz order equivalent to a frequency for images. Therefore, when an electron gun includes metal portions formed by deep-drawing metal materials such as stainless steel, the alternating magnetic field is damped and a desired electrode beam modulation cannot be obtained.

As shown in FIG. 6, the deflection yoke 24 is attached to the funnel cone portion. A portion of an alternating magnetic field 19 generated by the deflection yoke 24 passes a second anode 11 (G5 electrode). A portion of the alternating magnetic field 22 generated by the convergence yoke 23 passes the second anode 11. The velocity modulation coil 20 is disposed between a first anode 9 (G3 electrode) and a focusing electrode 10 (G4 electrode). A portion of the alternating magnetic field 21 generated by the velocity modulation coil 20 passes the first anode 9 and the focusing electrode 10. When an alternating magnetic field is applied through these metal electrodes, an eddy current is generated at the metal electrodes. The eddy current loss is increased as the frequency of the alternating magnetic field becomes high. Thus, the modulation effect of the electron beam due to the magnetic field in the high frequency modulation band is reduced.

SUMMARY OF THE INVENTION

It is an object of one or more embodiments of this invention to solve these problems and provide an electron gun for a cathode ray tube, which can provide a desired electron beam modulation effect substantially without interrupting transmission of the modulation magnetic field from the exterior.

An electron gun for a cathode ray tube according to the present invention includes a plurality of arranged tubular electrodes for passing electron beams inside the electrodes, the tubular electrodes being fixed to support rods respectively by support members. At least one of the tubular electrodes is separated into two parts, and the separated tubular electrode parts are connected electrically with each other by a coil member provided between the tubular electrode parts. Each coil member is composed of a wire with its tip ends being located within spaces formed by the support members.

Accordingly, an eddy current loss can be lowered since a modulation magnetic field passes through clearances between wire parts composing the coil member. Further, electric field emission of electrons from tip ends of the coil members is suppressed due to the location of the tip ends.

Preferably, each support member has a U-shape when viewed in the axial cross section, and each tip end of the wire composing the coil member is located within the space formed by a pair of parallel plates composing the support member. Thereby, a tip end of the coil member is located within a space formed by the support member and the support rod in order to reduce the exposed areas, and thus, electric field emission from the tip ends can be decreased.

It is preferable that the tip end of the wire is located at the central portion of the space in the axial direction. This configuration improves the effects for decreasing the electric field emission.

It is preferable that the coil member before being assembled into an electron gun has an inner diameter that is substantially the same as or smaller than an outer diameter of the separated tubular electrodes. The end portions of the separated tubular electrodes are inserted into the coil member, so that the tubular electrodes and the coil member are fitted and fixed to each other. Accordingly, the tubular electrode and the coil member can be fixed without welding.

Also it is preferable that the coil member before being assembled in the electron gun is longer than a mutual spacing between the respective support members of the separated tubular electrodes. The coil member presses the support members with the spring force so that the coil member is fixed to the tubular electrodes. Thus, the tubular electrode parts and the coil member can be fixed without welding.

Another electron gun according to the present invention comprises a plurality of arranged tubular electrodes for passing electron beams inside thereof, the tubular electrodes being fixed to support rods respectively by support members. At least one of the tubular electrodes is separated into two parts, and the two separated tubular electrode parts are connected electrically with each other by a coil member provided therebetween. Each coil member before being assembled into an electron gun has an inner diameter that is substantially the same as or smaller than an outer diameter of the separated tubular electrode parts. The end portions of the separated tubular electrodes are inserted into the coil member, so that the tubular electrodes and the coil member are fitted and fixed to each other.

Accordingly, the tubular electrode and the coil member can be fixed without welding.

It is preferable that the coil member before being assembled in an electron gun is longer than a mutual spacing between the respective support members of the separated tubular electrode parts. The coil member presses the support members with its spring force so that the coil member is fixed to the tubular electrode parts.

Thereby, the tubular electrode and the coil member can be fixed without welding.

DETAILED DESCRIPTION OF THE INVENTION

An embodiment of application of the electron gun according to the present invention to a monochrome cathode ray tube is explained below, with reference to FIGS. 1–5.

Figure 3:
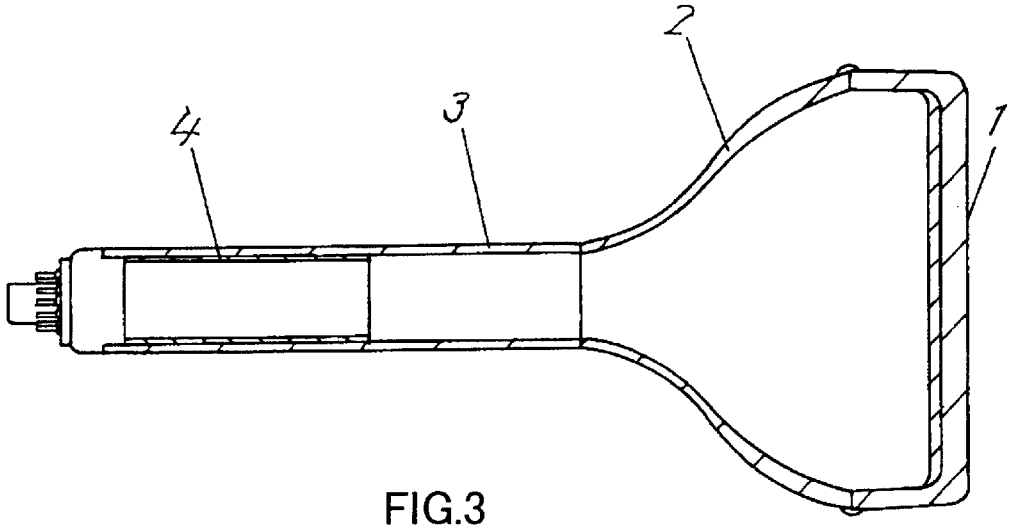
FIG. 3 is a schematic cross-sectional view of a cathode ray tube.

FIG. 3 is a schematic cross sectional view of a cathode ray tube according to an embodiment of the present invention. This cathode ray tube is a monochrome tube comprising a face plate 1, a funnel 2 and a neck tube 3. An electron gun 4 is provided inside the neck tube 3.

Figure 4:
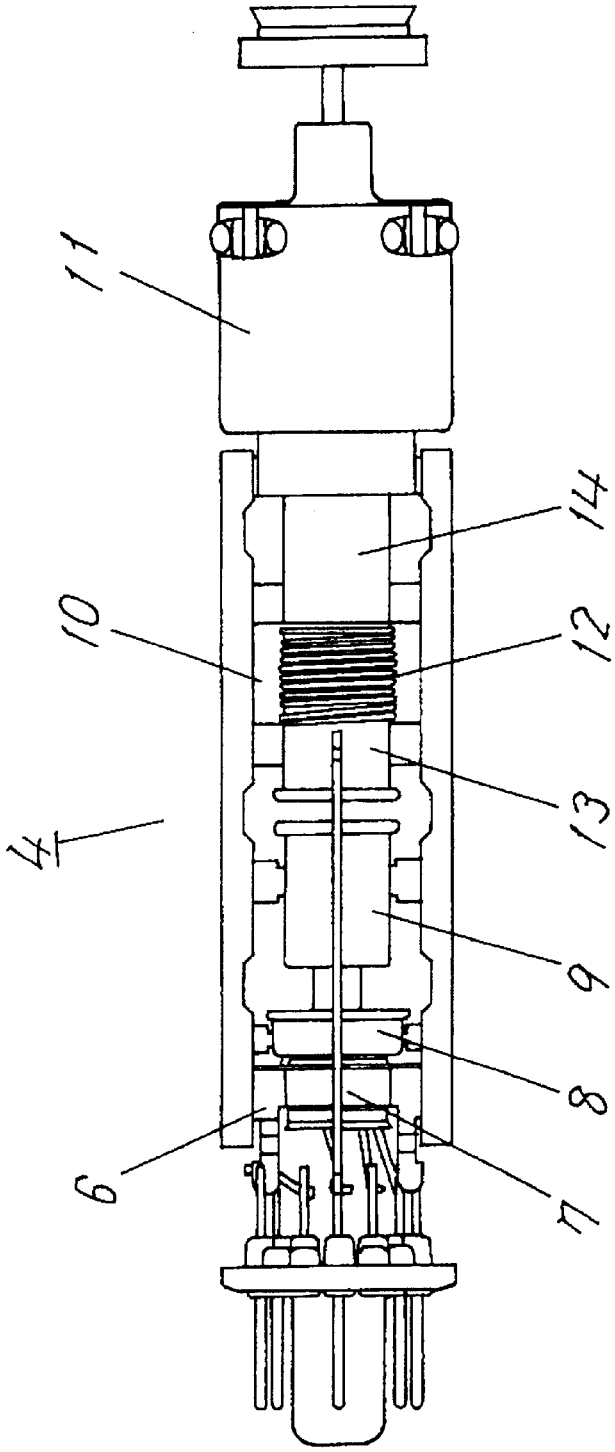
FIG. 4 is a side view of an electron gun in an embodiment of the present invention.
Figure 6:
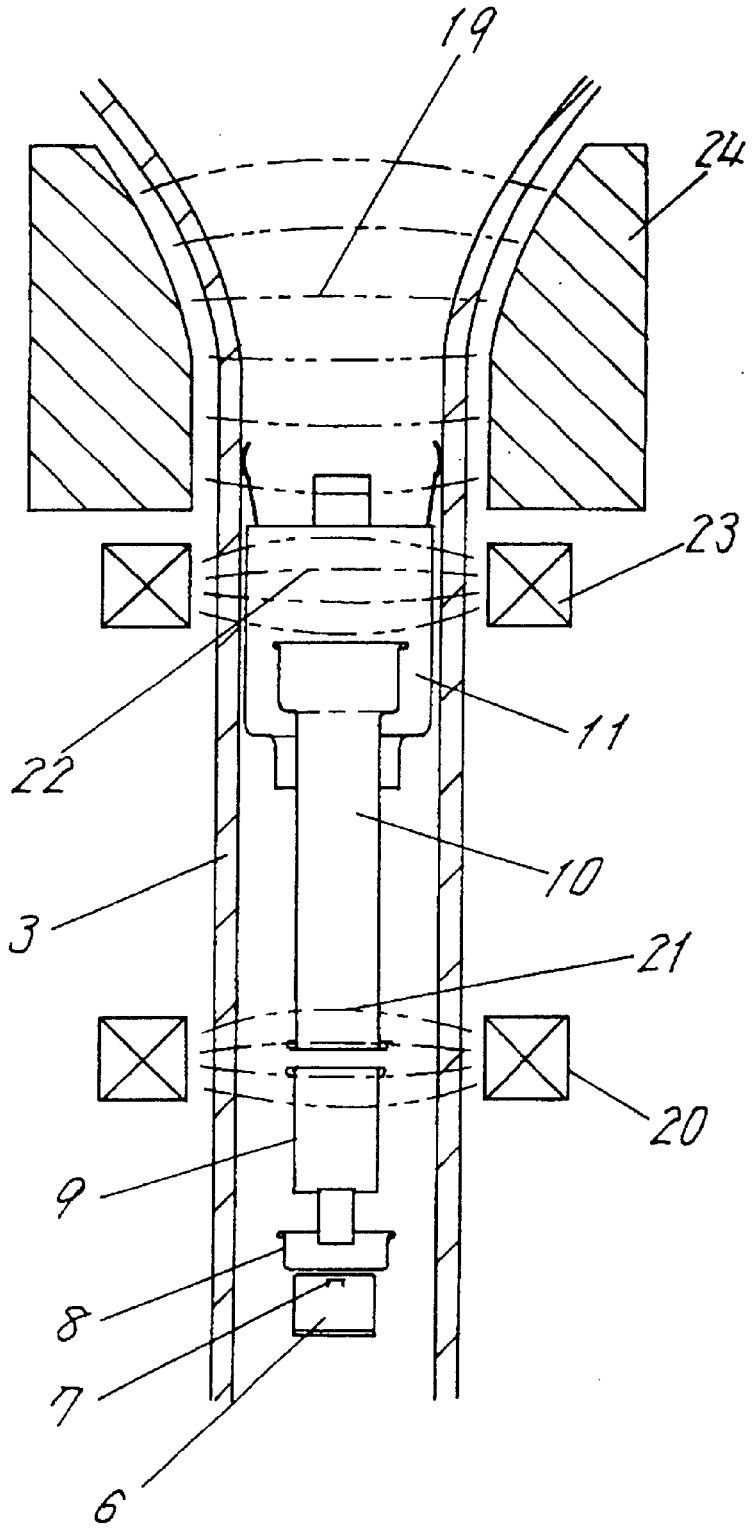
FIG.6 (PRIOR ART)
FIG. 6 is an enlarged cross-sectional view to show a neck portion of a conventional cathode ray tube.

FIG. 4 is a side view of the electron gun 4. The electron gun 4 is formed by sequentially arranging a G1 electrode (control electrode) 6, a G2 electrode (acceleration electrode) 8, a G3 electrode (first anode) 9, a G4 electrode (a focusing electrode) 10 and a G5 electrode (second anode) 11. The G1 electrode (control electrode) 6 is shaped like a cup for housing a cathode 7. The G2 electrode (acceleration electrode) 8 also is shaped like a cup and its bottom faces the bottom of the G1 electrode 6. The G3 electrode (first anode) 9 is tubular, and disposed at a predetermined spacing with respect to an opening side of the G2 electrode 8. A main lens is defined between the G4 electrode (focusing electrode) 10 and the G3 electrode 9. The G5 electrode (second anode) 11 envelops the top end of the G4 electrode 10. Another electron lens is formed inside the G5 electrode 11 at a position between the G4 electrode 10 and the G5 electrode 11. The G4 electrode 10 is separated into a first tubular electrode 13 and a second tubular electrode 14, and a coil member 12 is provided in a space between the tubular electrodes 13 and 14. The electrodes 13 and 14 are connected electrically with each other by the coil member 12, and thus, an equipotential space is formed inside the G4 electrode 10.

Figure 1:
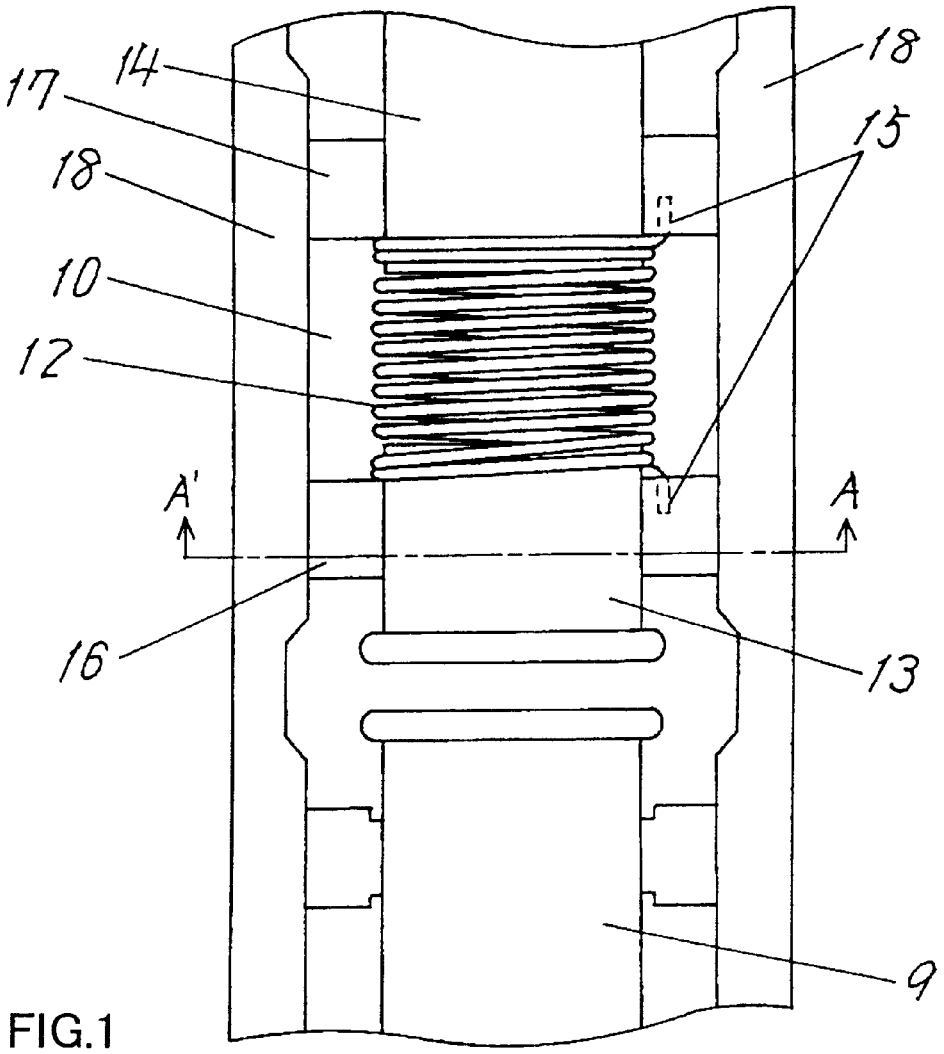
FIG. 1 is an enlarged side view to show a main part of an electron gun according to an embodiment of the present invention.
Figure 2:
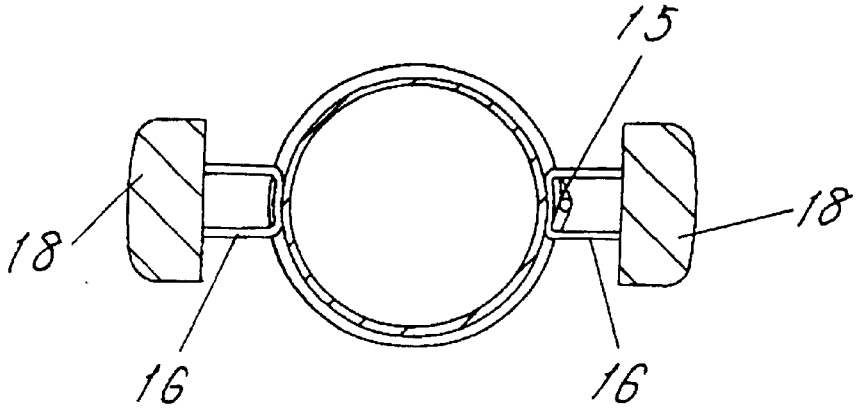
FIG. 2 is a cross sectional view of the electron gun of FIG. 1 taken along a line A–A'.

FIG. 1 is an enlarged side view to show a vicinity of the G4 electrode 10, and FIG. 2 is a cross-sectional view of FIG. 1 taken along a line A–A' (an axial cross section). The first tubular electrode 13 and the second tubular electrode 14 are fixed to the support rods 18 respectively by support members 16 and 17 that are shaped to have an axial cross section of a substantially U shape. The term "axial" refers to an axis of a cathode ray tube (or of an electron gun). The first and second tubular electrodes 13 and 14 may have the same outer diameter. The coil member 12 is formed by winding a metal wire. The following is a description of the coil member 12.

First description relates to a process of treating end portions 15 of the coil member 12. A metal wire composing the coil member 12 has tip ends. Therefore, field emission of electrons from the tip ends may occur easily, which is not preferable from the aspect of maintaining the performance of the electron gun. To avoid such a problem, the end portions 15 of the wire composing the coil member 12 are bent to be substantially parallel to the axial direction, so that each of the end portions 15 of the wire is located in a space formed by a pair of parallel plates of the support member 16 (or 17) as shown in FIGS. 1 and 2. In other words, the end portion 15 is located inside the U-shaped cross section. In this manner, the tip ends of the wire are covered with four surfaces including three inner surfaces of the support member 16 (or 17) and a surface of the support rod 18 facing the tubular electrode in order to reduce exposed areas. This will decrease electric field emission of electrons from the tip ends. Preferably, the tip ends of the wire are located substantially at center portions of the support members 16 and 17 in the axial direction, since a maximum effect will be obtained in preventing electric field emission.

The second description is directed to an inner diameter of the coil member 12. Before being assembled into an electron gun, the coil member 12 has an inner diameter that is substantially the same as or slightly smaller than an outer diameter of the first tubular electrode 13 and of the second tubular electrode 14. For assembling the G4 electrode 10, the first tubular electrode 13 and the second tubular electrode 14 are inserted respectively from both ends of the coil member 12 while the inner diameter of the coil member 12 is enlarged. The coil member 12 grips the first tubular member 13 and the second tubular electrode 14 from the outside with its spring force, so that the tubular electrodes 13 and 14 are fixed to the coil member 12. This configuration requires no welding. Welding can be carried out when a stronger fixing is required.

In the present invention, since the inner diameter of the coil member 12 can be varied freely, the first tubular member 13 and the second tubular member 14 can be connected by a single size of the coil member 12 even if the outer diameter of the first tubular member 13 is different from that of the second tubular member 14.

Alternatively, the G4 electrode 10 can be assembled by fixing the first tubular electrode 13 and the second tubular electrode 14 to support rods 18, and subsequently by contracting the coil member 12 to fit in the two tubular electrodes.

A third description is directed to the length of the coil member 12. The coil member 12 before being assembled in an electron gun is determined to be longer than a mutual distance between the support member 16 for the first tubular electrode 13 and the support member 17 for the second tubular electrode 14. The "mutual distance" denotes a distance between an end of the support member 16 facing the second tubular electrode 14 and an end of the support member 17 facing the first tubular electrode 13. In this manner, the end portions of the coil member 12 are pressed to the support members 16 and 17 by the spring force of the coil member 12 at the time of assembling the G4 electrode 10. This will restrain the coil member 12 from moving in the axial direction, and fix the coil member 12 with respect to the support members 16 and 17. Such a configuration will not require welding. As a result, a strong fixing can be provided by determining a length of the coil member 12 and also reducing the inner diameter of the coil member 12. Welding can be carried out if a stronger fixing is necessary. Sufficient effects in use can be obtained for the coil member 12 by employing only either of the above-mentioned determinations for the inner diameter or for the length.

Since the length of the coil member 12 can be varied freely in the present invention, the first tubular electrode 13 and the second tubular electrode 14 can be connected with each other by a single size of the coil member 12 even if the distance between the two electrodes varies depending on the kind of the electron gun.

As mentioned above in the present invention, a single size of the coil member 12 can cope with the assembly of various types of electrodes due to the flexibility of the coil member 12, even when the outer diameters and mutual distance of the first tubular electrode 13 and the second tubular electrode 14 vary.

A fourth description is directed to a position for providing the coil member 12. Preferably, the coil member 12 is located at a position where the velocity modulation coil is attached in view of allowing the velocity modulation magnetic field to penetrate. Therefore, the G3 electrode 9 can be coiled partially. Alternatively, both the G3 electrode 9 and the G4 electrode 10 can be coiled partially.

In a preferable embodiment described below, the present invention is applied to a monochrome cathode ray tube for a projection-type tube that is sized to be 16 cm (7 inches), and the neck tube diameter Φ is 29.1 mm. The coil member is made of a stainless wire 0.6 mm in diameter. The length is 10 mm, the inner diameter is 10.4 mm, and the pitch is 1.0 mm. The clearance between the adjacent wire parts of the coil member preferably ranges from 0 mm to 0.8 mm. Even if the adjacent wire parts are in contact with each other when the clearance is 0 mm, sufficient effects in transmitting modulation magnetic field can be obtained when compared to a case in which there is no joint, e.g., a case where a single plate is deep-drawn for manufacturing a tubular electrode. However, it is preferable that a slight clearance is provided between the adjacent wire parts to obtain a better modulation effect. It is not preferable for the clearance between adjacent wire parts to exceed 0.8 mm since the influence of the exterior electric field is increased.

Figure 5:
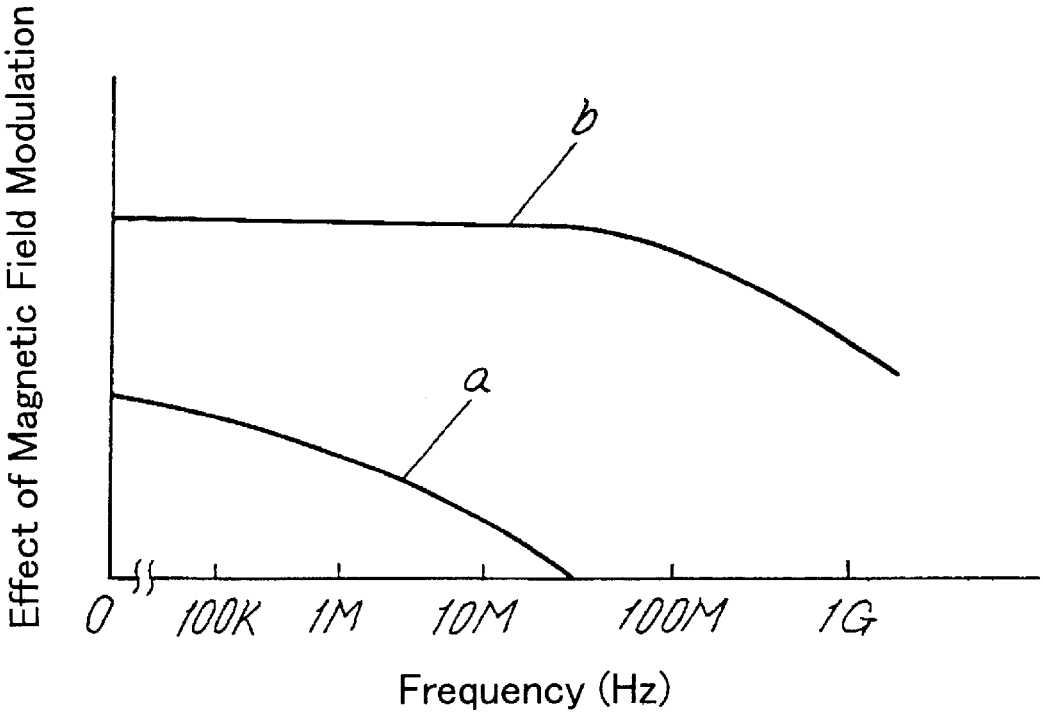
FIG. 5 is a graph to indicate an effect of magnetic field modulation in the present invention in comparison with that of a conventional technique.

FIG. 5 is a graph showing an effect of the present invention, indicating the relationship between the effect of the frequency of the magnetic field modulation (x axis) and the magnetic field modulation (y axis). The measurement was carried out in a case where picture signals of rectangular shape for displaying vertical stripes on the phosphor screen are supplied to the picture tube. The "effect of magnetic field modulation" indicates how much the width of the vertical lines on the phosphor screen varies between conditions with and without the velocity modulation. A higher value indicates the better effect for the magnetic field modulation. In FIG. 5, the curve (a) indicates a conventional electron gun without a coil member, and the curve (b) indicates an electron gun of the present invention having a metal coil member. As shown in FIG. 5, an electron gun of the present invention can provide a greater magnetic field modulation effect than the conventional gun over a wide range of frequencies.

Though the present invention is applied to a monochrome cathode ray tube in the above-mentioned embodiments, it also can be used for a color cathode ray tube. The section of the coil member can be shaped to be elliptic to be applied to an inline type electron gun. A position for providing the coil member is not limited to where a velocity modulation coil is provided, but the coil member can be located at a position where it is desired to improve transmission property of a magnetic field from other coils, or to decrease heat generation caused by an external magnetic field. Moreover, the support member is not limited to have a U-shaped cross section, but any shapes can be adopted as long as a space to hold a top end of the coil member can be formed.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. An electron gun for a cathode ray tube comprising a plurality of tubular electrodes arranged for passing electron beams inside the tubular electrodes and for accelerating and focusing electron beams, the tubular electrodes being fixed to support rods respectively by support members, wherein at least one of the tubular electrodes is separated into two parts, and the separated tubular electrode parts are connected electrically with each other by a coil member provided therebetween, and the coil member is composed of a wire with its tip ends being located outside of a tubular shape of the coil and within spaces formed by the support members.

2. The electron gun according to claim 1, wherein each of the support members has a U-shape when viewed in the axial cross section, and each tip end of the wire composing the coil member is located within a space between a pair of parallel plates composing the support member.

3. The electron gun according to claim 2, wherein the tip end of the wire is located at a central portion of the space in the axial direction.

4. The electron gun according to claim 1, wherein the coil member before being assembled into an electron gun has an inner diameter that is substantially the same as or smaller than an outer diameter of the separated tubular electrodes, the end portions of the separated tubular electrodes are inserted into the coil member, so that the tubular electrodes and the coil member are fitted and fixed to each other.

5. The electron gun according to claim 1, wherein the coil member before being assembled into an electron gun is longer than a mutual spacing between the respective support members of the separated tubular electrode parts, and the coil member presses the support members with its spring force in order to fix the coil member to the tubular electrode parts.

6. An electron gun comprising a plurality of tubular electrodes arranged for passing electron beams inside the tubular electrodes, the tubular electrodes being fixed to support rods respectively by support members, wherein at least one of the tubular electrodes is separated into two parts, and the separated tubular electrode parts are connected electrically with each other by a coil member provided between thereof, the coil member before being assembled into an electron gun has an inner diameter that is substantially the same as or smaller than an outer diameter of the separated tubular electrode parts, and the end portions of the separated tubular electrode parts are inserted into the coil member, so that the tubular electrode parts and the coil member are fitted and fixed to each other.

7. The electron gun according to claim 6, wherein the coil member before being assembled into an electron gun is longer than a mutual spacing between the respective support members of the separated tubular electrode parts, and the coil member presses the support member with its spring force in order to fix the coil member to the tubular electrode parts.

8. A cathode ray tube, comprising an electron gun according to claim 1.

* * * * *